US007736014B2

(12) United States Patent
Blomberg

(10) Patent No.: US 7,736,014 B2
(45) Date of Patent: Jun. 15, 2010

(54) HYBRID LIGHTING SYSTEM

(76) Inventor: Jerome O. Blomberg, 6201 27th St., Sacramento, CA (US) 95822

( * ) Notice: Subject to any disclaimer, the term of this patent is extended or adjusted under 35 U.S.C. 154(b) by 213 days.

(21) Appl. No.: 12/141,910

(22) Filed: Jun. 18, 2008

(65) Prior Publication Data

US 2008/0310147 A1 Dec. 18, 2008

Related U.S. Application Data

(60) Provisional application No. 60/944,733, filed on Jun. 18, 2007.

(51) Int. Cl.
*F21S 8/00* (2006.01)

(52) U.S. Cl. ..... 362/145; 362/576; 362/2; 362/20; 362/276; 362/147; 359/591; 359/599; 52/200

(58) Field of Classification Search ..... 362/145, 362/147, 576, 2, 20, 276; 359/591, 599; 52/200

See application file for complete search history.

(56) References Cited

U.S. PATENT DOCUMENTS

| | | | | |
|---|---|---|---|---|
| 4,114,186 | A * | 9/1978 | Dominguez | 362/35 |
| 4,539,625 | A * | 9/1985 | Bornstein et al. | 362/576 |
| 4,557,565 | A | 12/1985 | Ruck et al. | |
| 4,733,505 | A * | 3/1988 | Van Dame | 52/22 |
| 5,493,824 | A | 2/1996 | Webster et al. | |
| 5,729,387 | A | 3/1998 | Takahashi et al. | |
| 5,999,323 | A | 12/1999 | Wood | |
| 6,000,170 | A | 12/1999 | Davis | |
| 6,130,781 | A * | 10/2000 | Gauvin | 359/591 |
| 6,142,645 | A * | 11/2000 | Han | 362/147 |
| 6,493,145 | B1 | 12/2002 | Aoki et al. | |
| 6,502,950 | B2 * | 1/2003 | Signer | 362/147 |
| 6,604,329 | B2 | 8/2003 | Hoy et al. | |
| 6,623,137 | B1 * | 9/2003 | Marsonette | 362/145 |
| 6,655,814 | B1 | 12/2003 | Tagawa et al. | |
| 6,827,445 | B2 | 12/2004 | Abe et al. | |
| 6,840,645 | B2 * | 1/2005 | Eisenman et al. | 362/2 |
| 6,870,673 | B2 * | 3/2005 | Cromer et al. | 359/450 |
| 7,222,461 | B2 | 5/2007 | Piano et al. | |
| 7,322,156 | B1 | 1/2008 | Rillie et al. | |
| 7,395,636 | B2 | 7/2008 | Blomberg | |
| 2002/0060283 | A1 | 5/2002 | Jordan et al. | |
| 2002/0073635 | A1 | 6/2002 | Erskine | |
| 2004/0050380 | A1 | 3/2004 | Abe et al. | |
| 2005/0005542 | A1 | 1/2005 | Prenn et al. | |
| 2005/0039789 | A1 | 2/2005 | Kim | |
| 2005/0243430 | A1 | 11/2005 | Cuttle | |
| 2007/0163732 | A1 | 7/2007 | Konstantin et al. | |
| 2007/0271848 | A1 | 11/2007 | Wolf et al. | |

* cited by examiner

*Primary Examiner*—Ali Alavi
(74) *Attorney, Agent, or Firm*—Bullivant Houser Bailey PC

(57) ABSTRACT

The invention provides a lighting apparatus comprising: a) a frame spanning the roof and interior of a building, the frame having a first opening at the building roof and a second opening opposed to the first opening at the building ceiling; b) a skylight at the first opening; c) a reflective lining between the first and second openings; d) a light diffuser at the second opening; and e) at least one artificial light source located between the skylight and the diffuser; where the artificial light source is positioned at the frame periphery.

23 Claims, 3 Drawing Sheets

HYBRID LIGHTING SYSTEM

REFERENCE TO RELATED APPLICATIONS

This application claims the benefit of U.S. Provisional Patent Application No. 60/944,733, filed Jun. 18, 2007, the complete disclosure of which is incorporated herein, in its entirety.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files and records, but otherwise reserves all other copyright rights.

BACKGROUND OF THE INVENTION

1. Field of the Invention

The present invention relates passive solar and electric lighting systems.

2. Description of Related Art

Various roof lighting, or skylighting, systems have been developed for directing sunlight through the roof to the building interior.

U.S. Pat. No. 6,604,329, describes a common skylighting system, for those situations where sunlight is to be conveyed through an attic or other extensive ceiling structures. Typically, the light is conducted through an elongated tube, generally square or rectangular in cross-section, and having light reflecting inner surfaces. The tube will extend through the ceiling structures of a building with an upper end covered by a light transmitting skylight attached to the roof of the building and a lower open end covered by a light transmitting and diffusing panel or lens at the ceiling level.

The problem with many such skylighting systems is the highly variable amount of light that is directed into the building interior, due to the variance in the intensity of ambient sunlight from season to season, day to day, and even hour to hour. Further, depending on the climate and season, the intensity of sunlight entering through the skylighting system may be, at times, too much, either in terms of the brightness of the light, or in the heating of the building interior.

Various systems have been proposed to compensate for this variance in light. U.S. Pat. No. 6,827,445, and U.S. Pat. No. 5,493,824, each describe a system for tracking the direction of the sun, to maximize the amount of sunlight entering the skylight opening on the roof. In United States Patent Application No. 2002/0073635, reflective mirrors are incorporated into the systems that change angles to direct reflected sunlight into the building.

Other systems seek to limit the intensity of light entering the system. United States Patent Application No. 2005/0005542, and U.S. Pat. No. 6,000,170, control intensity of sunlight by adding shutters or louvers to the system to reduce the amount of sunlight that enters the building. U.S. Pat. No. 7,222,461, teaches the use of shading surfaces on the roof of the building, to prevent direct sunlight from even passing into roof skylight.

In U.S. Pat. No. 5,729,387, prism plates and light detectors are utilized to precisely control the intensity and direction of sunlight directed through the system.

No skylight system can completely compensate for the variance in sunlight over the course of a day, from dawn to dusk. In some systems, sunlight from the skylighting system is supplemented by artificial lighting in an attempt to even out the variance in light brought into the building. U.S. Pat. No. 6,142,645, teaches one such skylighting system that includes a lighting fixture attached to a lighting opening provided in the frame. This provides an alternative lighting system that can be turned on when the sunlight falls between a certain level.

United States Patent Application No. 2002/0060283, incorporates a light metering device and adjacent artificial lighting light source in the tube, such that when the detected sunlight rate is too low, the artificial light is increase. The problem with this system is that the artificial lighting apparatus shades or blocks the sunlight from entering the building.

The problem remains, then, to provide a lighting system that can seamlessly and efficiently control the intensity of light directed into interior of a building from a skylighting apparatus. None of the prior approaches has been able to provide a simple skylighting system that is adapted to convey a steady source of light year round to a building interior.

SUMMARY OF THE INVENTION

The invention provides a lighting apparatus comprising: a) a frame spanning the roof and interior of a building, the frame having a first opening at the building roof and a second opening opposed to the first opening at the building ceiling; b) a skylight at the first opening; c) a reflective lining between the first and second openings; d) a light diffuser at the second opening; and e) at least one artificial light source located between the skylight and the diffuser; where the artificial light source is positioned at the frame periphery.

In a further preferred embodiment, the frame is insulated. The frame structure may be produced of any suitable structural material, such as wood or steel, for example.

In a different preferred embodiment, the reflective lining is a highly reflective steel.

In a still different preferred embodiment, the artificial light source comprises at least one multiple-lamp ballast, which are preferably arranged at each of four periphery walls.

In a further preferred embodiment, separate lamps are placed on discrete switching circuits.

In a still further preferred embodiment, each switching circuit controls at least one lamp positioned on each of the four periphery walls.

In another preferred embodiment, the first opening incorporates shading structure, for example by movable slats, louvers and the like.

In a further preferred embodiment, the frame structure is produced of steel.

In a further preferred embodiment, the inside dimension of the framed structure is rectangular. Preferred inside dimension of the frame structure vary from at least about 27½"×27½", at least about 39½"×39½", and at least about 51½"×51½".

In a further preferred embodiment, the frame comprises first and second sections having respective first and second cross dimensions, where the second dimension is greater than the first dimension, and where the artificial light source is positioned in within the second section.

In a still further preferred embodiment, the artificial light source is positioned outside of the limits of the first dimension. The lighting system may include a hinged flange located between the first and second sections.

In a still further preferred embodiment, the second section is angled with respect to the first section, for instance at an angle of about 45 degrees relative to the first section.

In one embodiment, the lighting apparatus may include a photo-cell for detecting light entering the frame, and a microprocessor for controlling the intensity of the artificial light source in response to light detected by the photo-cell.

These and other features and advantages of this invention are described in, or are apparent from, the following detailed description of various exemplary embodiments of the apparatus and methods according to this invention.

BRIEF DESCRIPTION OF THE DRAWINGS

A more complete understanding of the present invention and the attendant features and advantages thereof may be had by reference to the following detailed description when considered in conjunction with the accompanying drawings wherein.

DETAILED DESCRIPTION OF THE INVENTION

This invention provides a single fixture, integrated passive solar and electric lighting apparatus, or system 10, which can include digital controls to provide optimal user control while maximizing energy savings.

Figure 1:
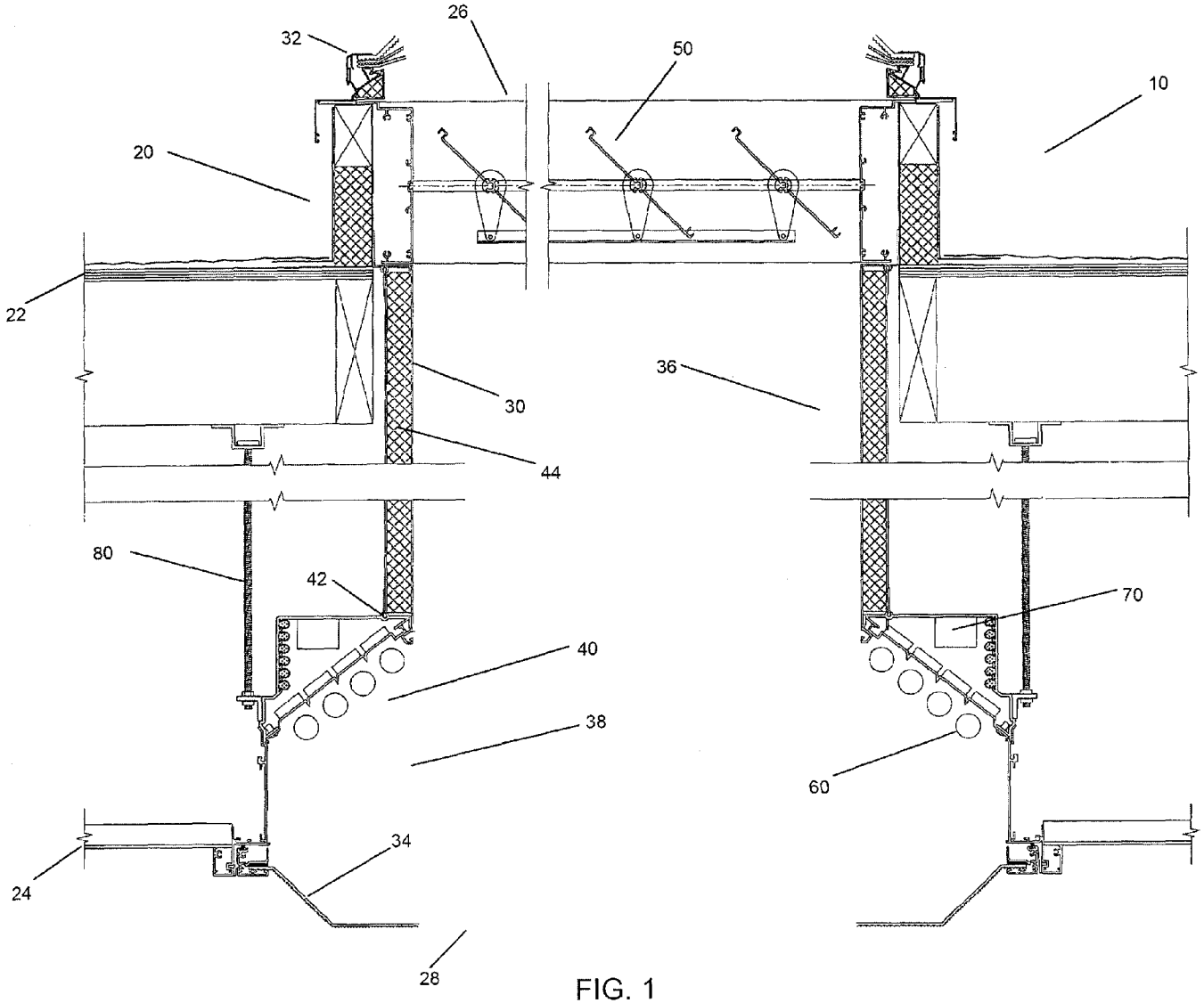
FIG. 1 shows a cut away view of the skylighting system of the invention showing the louvers.
Figure 2:
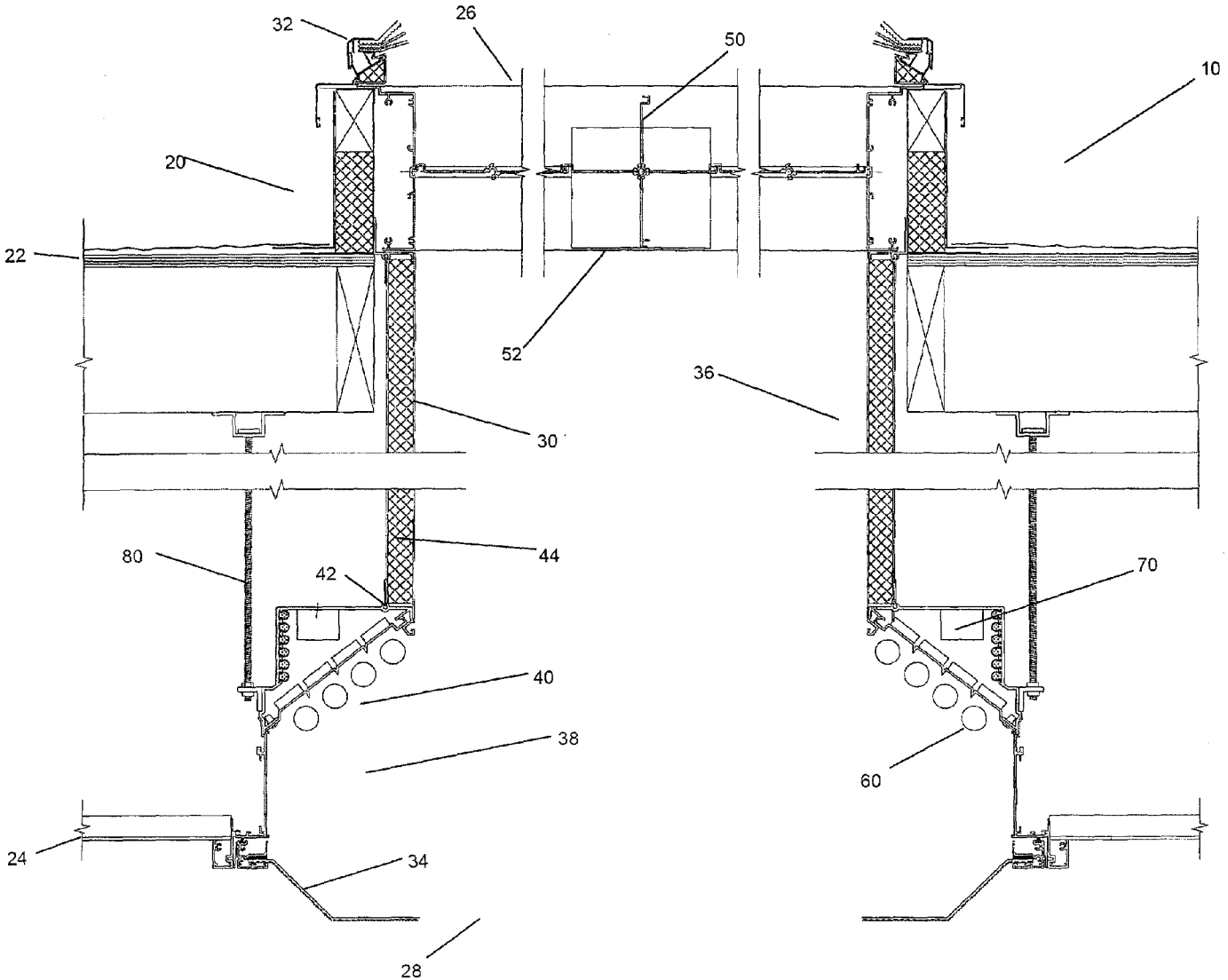
FIG. 2 shows a cut away view of the skylighting system from the opposite view, showing the motor.
Figure 3:
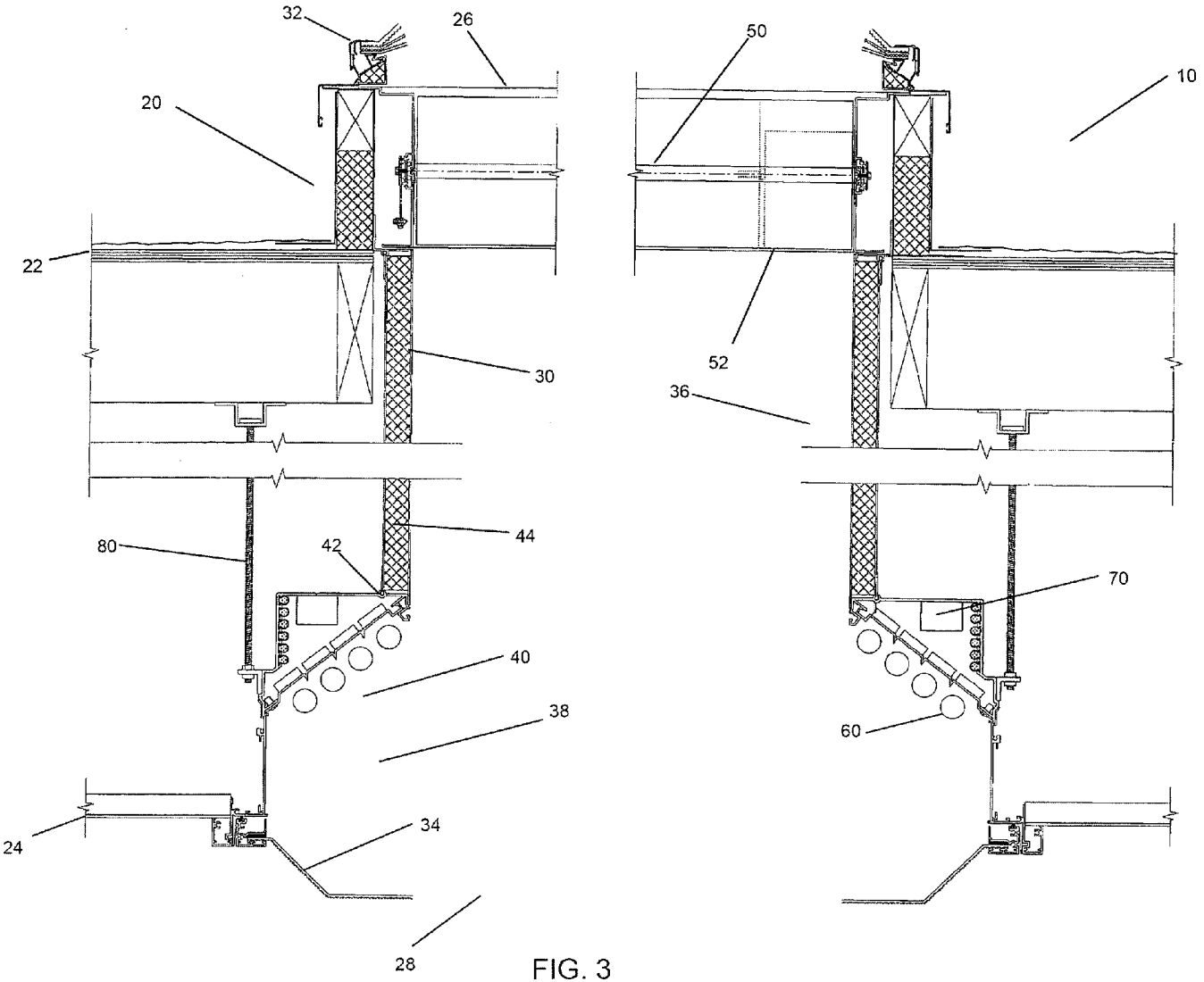
FIG. 3 is a side cut away side view of the skylighting system of the invention.

In reference now to FIGS. 1, 2 and 3, the passive solar lighting and electric lighting system, or lighting apparatus 10 generally comprises a tubular defined by a frame 20 spanning the roof 22 and interior ceiling 24 of a building, the frame 20 having a first opening 26 at the building roof 22 and a second opening 28 opposed to the first opening 26, and located generally at the level of the building ceiling 24.

A reflective lining 30 for the frame 20 is located between the first opening 26 and second opening 28. The highly reflective, insulated light well liner 30 is attached to the frame by conventional means, and can be extended any distance as required to span the roof 22 to ceiling 24 distance.

A skylight 32 covers the first opening 26 and a prismatic diffuser or drop lens 34 the second opening 28.

A single, double, or even triple glazed skylight 32 of the appropriate size is fitted on top of the first opening 26 at the building roof 22, by conventional means. In the Figures a triple glazed skylight 32 is depicted.

The frame may comprise a first section 36 and second section 38 having respective first and second cross dimensions. The second section 38 is angled with respect to the first section 36, for instance at an angle of about 45 degrees relative to the first section 36.

The second dimension is greater than the first dimension, and an artificial light source 40 is positioned within the second section 38. In this fashion, the artificial light source 40 positioned outside the limits of the first section 36. The first inside dimension of the frame of the integrated solar and electric lighting system is typically at one of 51½" by 51½", 39½" by 39½", and 27½" by 27½".

The frame 20 interior also includes at least one artificial light source 40 located between the skylight 32 and the diffuser 34, and positioned at the frame periphery.

A hinged flange 42 is located between the first section 36 and the second section 38 where the well corner assemblies attach. The liner 30 attaches to this continuous top hinged flange 42. As depicted in the figures, the insulation 44 backs the liner 30, and provides a substantial location for attachment. The purpose of the hinged flange 42 is to allow the frame 20 to adjust to misalignment of the frame 20 and the ceiling 24, which is determined by the suspended layout.

The height of the frame 20 can be any height as required by the building designer.

Looking more particularly to FIG. 1, it can be seen that the first opening 26 can be fitted with motorized movable slats or louvers 50. The movable slats or louvers 50 act as a system to control the amount of passive sunlight entering through the first opening 26. The control can be The bottom opening 28 of the frame 20 can fabricated as a rectangle, preferably a square, with the center completely open for solar light to flow through, with no interference of the solar light flow from the light fixture.

The apparatus 10 is designed to have four levels to control the amount of light. Each level controls four lamps 60, one on each of the four sides of the opening 28, constituting a total of 16 lamps for each lighting apparatus 10. Ballasts 70 control the lamps 60. Depending upon the size of the apparatus 10, the fixtures 40 can accommodate up to 16, 2 foot, 3 foot or 4 foot lamps. The apparatus 10 should contain sufficient artificial or electric light to illuminate the same area as the skylight 32 can during the daylight hours.

The apparatus 10 simplifies the building design requirements and also the aesthetics by having only one lighting opening. The lens 34 will conceal the light well, the frame 20 and the artificial light source 40, providing the perception of a single light source to an individual occupying the building.

By having the artificial light come out of the same lighting fixture 40 as the passive solar light, with four levels to control the amount of electric lighting with the added capability turning off the electric lighting altogether, the user can make changes in the light source between electric light and solar lighting, virtually imperceptible.

The use of four levels to control the amount of electric lighting in conjunction with dedicated ballasts 70 for each set of four lamps 60 provides greater energy efficiency at substantially lower ballast cost than the use of continuous dimming ballasts.

The entire lighting system is controlled with a photo-diode photocell (not depicted), which can be placed under the skylight 32 facing toward the sky and below the louvers 50, if a louvering system is used in the building design. Louvers 50 would most typically be used in auditoriums, classrooms and offices where blocking the light is desirable at certain daylight hours.

The photo-diode photocell creates a voltage signal that goes to a LCM 4000 control board. The control board is calibrated to adjust the louvers to maintain the desired light level. When the louvers 50 are fully open, and there is insufficient daylight to maintain the desired light level, one circuit activates a ballast 70 and turns four lights 60 on. As the daylight continues to diminish at the end of the day, or is reduced due to increased cloud cover, additional circuits will turn on until all 16 lamps 60 are on.

When the lighting system 10 is turned off at night the louvers 50 close, and all the electric lights 60 go off. The reverse occurs in the morning.

If it is nighttime outside when the lighting system 10 is activated, the louvers 50 fully open and all 16 lamps 60 turn on. As the day brightens the lights 60 will switch off one circuit at a time until there is sufficient daylight to have all 16 lamps 60 off. When there is more daylight available than the set point requires the louvers 50 will partially close to maintain the set point lighting levels.

In practice, at each day the sequence of the lighting circuits rotate so that all lamps 60 will age at the same rate. When the correct time to relamp the fixture comes, all lamps 60 will be of the same age, and can be replaced at the same time.

As one example of a control, a control knob on the face of an LCM 4000 is placed at 12-0 clock (the set point) when the controls are calibrated. By turning the control knob counter clockwise, the passive solar light is dimmed during the daylight hours. When there is insufficient daylight, the number of circuits that can come on is reduced, which is equivalent to dimming the electric lighting. The farther the knob is turned counterclockwise, the dimmer the daylight or electric light will be. When there is no daylight the fewer electric lighting circuits will be turned on.

When the knob is turned counterclockwise as far as it can go the louvers will close all the way and the lights will not come on. If there is sufficient daylight to cause the louvers to be partially closed and there is a desire to have higher light levels in the space the knob can be turned clockwise to cause the louvers to be set at a higher light level.

The louvers 50 will maintain the recalibrate daylight level, but when the louvers 50 are wide open and there is insufficient daylight, the electric lights 60 will not come on. This optimizes user control while guaranteeing energy savings. Placing the control knob back at the set point will allow the electric lights to come on. There can be an override button on the control board face that can give 30, 60, or 90 minutes of electric lighting override, even when there is sufficient daylight to have the electric lights off.

The frame 20 can be secured to the roof 22 by an conventional means, such as by a hanging rods 80 secured to the roof 22 structure and the frame 22.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of this invention.

What is claimed is:

1. A lighting apparatus comprising:

a) a frame spanning the roof and interior of a building, said frame having a first opening at the building roof and a second opening opposed to the first opening at the building ceiling;

b) a skylight at said first opening;

c) a reflective lining between said first and second openings;

d) a light diffuser at said second opening; and e) at least one artificial light source located between said skylight and said diffuser;

wherein said artificial light source is positioned at said frame periphery.

2. The lighting apparatus of claim 1 wherein said frame is insulated.

3. The lighting apparatus of claim 1 wherein said reflective lining is a highly reflective steel.

4. The lighting apparatus of claim 1 wherein said artificial light source comprises at least one multiple-lamp ballast.

5. The lighting apparatus of claim 4 wherein said artificial light source comprises a multiple-lamp ballast located at each of four periphery walls.

6. The lighting apparatus of claim 5 wherein separate lamps are on discrete switching circuits.

7. The lighting apparatus of claim 6 wherein each switching circuit controls at least one lamp positioned on each of said four periphery walls.

8. The lighting apparatus of claim 1 wherein said first opening incorporates shading structure.

9. The lighting apparatus of claim 8 wherein said shading structure comprises movable slats.

10. The lighting apparatus of claim 8 wherein said shading structure comprises louvers.

11. The lighting apparatus of claim 1 wherein said frame structure is produced of wood.

12. The lighting apparatus of claim 1 wherein said frame structure is produced of steel.

13. The lighting apparatus of claim 1 wherein the inside dimension of said framed structure is rectangular.

14. The lighting apparatus of claim 13 wherein the inside dimension of said frame structure is at least about 27½"× 27½".

15. The lighting apparatus of claim 14 wherein the inside dimension of said frame structure is at least about 39½"× 39½".

16. The lighting apparatus of claim 15 wherein the inside dimension of said frame structure is at least about 51½"× 51½".

17. The lighting apparatus of claim 1 wherein said frame comprises first and second sections having respective first and second cross dimensions, wherein said second dimension is greater than said first dimension, and wherein said artificial light source is positioned in within said second section.

18. The lighting apparatus of claim 17 wherein said artificial light source is positioned outside of the first dimension.

19. The lighting apparatus of claim 17 comprising a hinged flange located between said first and second sections.

20. The lighting apparatus of claim 17 wherein said second section is angled with respect to said first section.

21. The lighting apparatus of claim 20 wherein said second section is angled about 45 degrees relative to said first section.

22. The lighting apparatus of claim 1 further comprising a photo-cell for detecting light entering said frame.

23. The lighting apparatus of claim 22 further comprising a micro-processor for controlling the intensity of said artificial light source in response to light detected by said photo-cell.

* * * * *